United States Patent [19]

Utreja et al.

[11] Patent Number: 4,850,275

[45] Date of Patent: Jul. 25, 1989

[54] AIRCRAFT HOLLOW NOSE CONE

[75] Inventors: Lajpat R. Utreja, Harvest; William H. Gurley, Huntsville, both of Ala.

[73] Assignee: The BDM Corporation, McLean, Va.

[21] Appl. No.: 114,711

[22] Filed: Oct. 30, 1987

[51] Int. Cl.[4] ..... F42B 15/02

[52] U.S. Cl. ..... 102/293; 244/3.16

[58] Field of Search ..... 244/3.16, 3.17, 3.18, 244/177 A, 130; 102/501, 293

[56] References Cited

U.S. PATENT DOCUMENTS

| | | | |
|---|---|---|---|
| 3,747,530 | 7/1973 | Tepper | 244/3.16 |
| 3,954,228 | 5/1976 | Davis, Jr. | 244/3.16 |
| 3,971,939 | 7/1976 | Andressen | 250/339 |
| 4,085,910 | 4/1978 | Baker et al. | 244/3.16 |
| 4,142,696 | 3/1979 | Nottingham | 244/3.16 |
| 4,291,849 | 9/1981 | Rodgers et al. | 244/3.16 |
| 4,339,097 | 7/1982 | Kordulla et al. | 244/3.16 |
| 4,500,051 | 2/1985 | Cottle, Jr. et al. | 244/3.16 |
| 4,568,040 | 2/1986 | Metz | 244/3.16 |
| 4,576,346 | 3/1986 | Gauggel et al. | 244/3.16 |
| 4,598,884 | 7/1986 | Speer | 244/3.16 |
| 4,600,166 | 7/1986 | Califano et al. | 244/3.16 |
| 4,615,496 | 10/1986 | Pinson | 244/3.16 |
| 4,619,421 | 10/1986 | Trummer | 244/3.16 |
| 4,703,904 | 11/1987 | Haslund | 244/130 |

FOREIGN PATENT DOCUMENTS

| | | | |
|---|---|---|---|
| 15099 | 2/1977 | Japan | 244/3.16 |

OTHER PUBLICATIONS

"Supersonic Flow Over Convex and Concave Shapes With Radiation and Ablation Effects," Bohachevsky and Kostoff, AIAA Journal, vol. 10, No. 8, Aug. 1972.

"Heat Transfer and Pressure Measurements on a Concave-Nosed Cylinder for a Mach Number," Stallings, Jr. and Burbank, NASA Technical Information, 10/59.

"Investigation of the Flow Dynamics of a Forward Facing Nose Cavity at Mach 10" Marquart and Grubb, Calspan Corp./AEDC Div. Feb. 1987.

*Primary Examiner*—Deborah L. Kyle
*Assistant Examiner*—Richard W. Wendtland
*Attorney, Agent, or Firm*—Dickstein, Shapiro & Morin

[57] ABSTRACT

An improved hypersonic aerodynamic configuration which has a nose portion and cavity formed at the bow of the nose portion. An optical window arrangement is provided at the base of the cavity such that during flight, temperatures at the optical window are reduced as a result of maintaining the cavity substantially within a subsonic region of the bowshock. The cavity can be gas pressurized in order to maintain a stable pressure and reduce the amplitude of shock oscillations in front of the cavity produced by movement of the bowshock. The cavity configuration also achieves a reduction in optical aberrations about the optical window by maintaining a line of sight near normal to the bowshock. The cavity also produces reduced heat and turbulence about the optical window compared to a window location equidistant from the nose to the side of the cone.

37 Claims, 5 Drawing Sheets

AIRCRAFT HOLLOW NOSE CONE

BACKGROUND OF THE INVENTION

1. Field of the Invention

The present invention involves an improved nose cone structure and seeker housing for an aircraft.

2. Background of the Prior Art

In a variety of aircraft, the optical window for seeker systems have been placed in the nose of the aircraft. A conventional convex nose placed in a supersonic air stream is enveloped by a shock wave lying close to the nose cone surface. Within the shock layer, the temperature and pressure of the gases increase to extremely high values because of the resulting high compression ahead of the nose body. For example, temperatures reach as high as 14,000° R behind a mach 16 flow at a 60,000 foot altitude. The resulting flowfield, in turn, creates substantial aberrations in optical transmission/reception, increased complexity to the design of the optical system and decreased targetting accuracy.

In a side-looking window on an aircraft with a conventional nose cone, FIG. 1, flying at hypersonic speeds window well 12 is subjected to the supersonic gas flow. In order the overcome the temperature constraints, side-looking optical windows have required window cooling equipment to reduce aero-optical effects produced by the high temperatures. Any inclusion of a cooling system, however, necessarily adds expense, weight and increased complexity. The flow about the window well 12 consists of several layers including an outer undisturbed shock layer 16, a mixing layer 18, a window coolant boundary layer 19 and a window shock 22. The interaction between these layers creates a complex flow field which, in turn, impacts on optical signal transmission.

As discussed, placement of the window along the side of the nose reduces optical signal quality. Depending on the optical system, an optical signal may make a single or double pass through a complex flow field composed of a curved shock layer, a coolant mixing layer, and a transition or turbulent boundary layer. The aero-optical effects resulting from such a passage may include bore sight error, image blur or distortion, beam divergence, scintillation, absorption and unpredictable fluctuations of one or more of these features. The optical signal, for example, can be subject to unsteady density fluctuations in the window field of view such that the random wave front errors reduce signal resolution. The curved density contours along the shock layer can also produce wave front astigmatisms and higher order aberrations distorting the optical image. Turbulence along the boundary and mixing layers of the window cooling system can also introduce image blur, beam divergence and significant signal scintillation. Temperature also impacts on optical quality where ablation products can change the mean radiance and transmittance of the flow field and, combined with the aforementioned turbulence, results in fluctuating absorption of the optical signal.

The loss of efficiency, therefore, entails expensive alternatives. The loss can have other impacts. In missile applications, for example, the use of warheads becomes essential where an aircraft guidance system cannot be depended upon to actually contact the target.

Conventional aeronautic nose cone designs for front or side-looking seeker windows, therefore, have substantial drawbacks for optimizing heat, pressure and optical transmission about the optical window.

SUMMARY OF THE INVENTION

It is, therefore, an object of the present invention to overcome these deficiencies by providing a hollow nose cone configuration that yields reduced heat at the optical window of the seeker and improved optical quality for signals transmitted from and received by the seeker circuitry.

These results are accomplished by providing a nose having a bow and aft where the bow of the nose is convex edged ring. A cavity is formed by extending the inner surface of the ring toward the aft. The base portion of the cavity is located at the aft and is parallel to the plane of the front surface. An optical window is situated along the base portion whereby during flight a reduction in heat and pressure about the optical window occurs. The change in heat and pressure, in turn, favorably impact on the quality of optical signals.

Moreover, the cavity is gas pressurized or evacuated such that the window is contained within the subsonic flow portion behind the bowshock having relatively stable low pressure. Accordingly, temperatures about the recessed optical window are greatly reduced. Optical signals are near normal to the bowshock.

It is a further object of the invention to provide a hollow nose configuration that does not require a cooling system for the optical window.

It is yet another object of the invention to provide a nose cone configuration having a gas pressurization-evacuation system for providing near constant density pressure within the nose cavity regardless of variation in the angle of attack or speed of the aircraft.

It is yet a further object of the invention to provide a hollow nose configuration that is adapted to be employed in endoatmospheric conditions.

It is still another object of the invention to provide an improved seeker configuration having a laser range finder/receiver, a laser transmitter, and an infrared receiver adapted to provide forward directed laser and infrared signals near normal to the curvature of the bowshock.

It is still a further object of this invention to provide the optical window in a seeker cavity whereby pressure in the cavity is close to stagnation pressure behind the bowshock formed about the aircraft nose.

It is yet a further object of this invention to provide a hollow nose configuration where the static pressure level inside the cavity remains nearly constant with changes in the angle of attack.

It is yet an additional object of the present invention to provide a nose configuration wherein the depth of the cavity is sufficient to achieve a significant reduction in the velocity and heat convection at the window and to minimize conductive heat from the rim.

It is another object of the invention to provide a sufficiently shallow cavity to minimize constriction of the optical field.

It is a further object of the invention to provide for a configuration where the nose cone rim has a circular cross section and a generally convex longitudinal cross section such that sharp points that concentrate heat flux are avoided and the rim shape retains the bowshock in a completely detached state regardless of the aircraft's speed or its angle of attack.

It is yet another object of the invention to provide for an optical configuration where higher order optical defects are absent due to near normal lines of sight through the bowshock. Minor defocus errors, which correspond to changes in density through the bowshock, are correctable by translation of the secondary mirror of a telescope located in seeker package.

It is still another object to the invention to enclose the nose with a seeker shroud having a generally conical shape. The base of the shroud is adapted to extend over the front surface of the nose and is attached in such a that it automatically detaches from the nose at an appropriate altitude.

The aircraft nose structure further includes a seeker package located adjacent the aft portion of the nose. The seeker package includes a laser transmitter, a pair of folding mirrors or a single folding prism for directing a laser beam from the transmitter through the window. The seeker arrangement is also provided with a laser range finder and receiver, and primary and secondary mirrors for orienting incoming signals toward the laser range finder through a fiber optic coupling.

The system further provides for an infrared receiver and a beam splitter for separating signals for the laser range finder from signals for the infrared receiver. A guidance and control section is located behind the aft portion of the seeker package.

In sum, the nose cone structure provides for reduced heat and stable pressure about the optical window such that improved optical transmission/reception through the window is achieved. Gas pressurization into the cavity further reduces bowshock pressure oscillation in the cavity, static pressure rise and window heat transfer. The nose configuration results in completely detaching the bowshock during endoatmospheric use.

BRIEF DESCRIPTION OF THE DRAWINGS

Other objects of the invention will become apparent by reference to the following detailed description taken in conjunction with the accompanying drawings, in which.

DETAILED DESCRIPTION OF THE PREFERRED EMBODIMENTS

Figure 1:
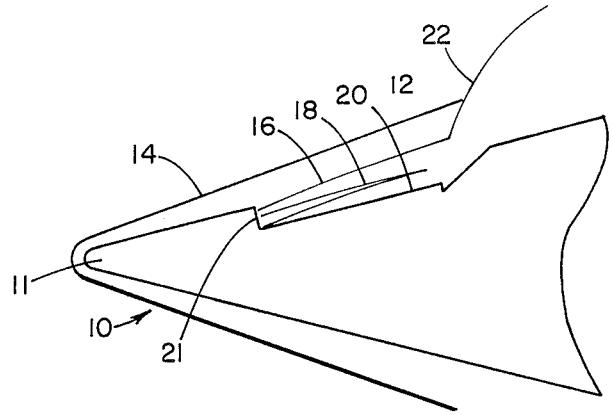
FIG. 1 (PRIOR ART)
FIG. 1 is a cross sectional view of a conventional optical window configuration.

The characteristics of the invention will be clear from the detailed description made with reference to the accompanying drawings wherein like reference numerals illustrate the features of the invention. FIG. 1 shows a conventional nose cone configuration for an aircraft. The optical window 20 is mounted about the side portions of a convex nose cone 10. In such designs at hypersonic speeds, a bowshock 14 is formed with a supersonic flow in the shock layer between the bowshock and the optical window. Placement of optical window 20 adjacent the supersonic layer requires window cooling. As a result, an optical signal transmitted through the window is subjected to a combination of an undisturbed shock layer 16, a turbulent mixing layer 18, a coolant boundary layer 19 and a downstream window shock 22. The difficulties presented by the design of FIG. 1 are overcome by the design of the present invention as shown in FIG. 2.

Figure 2:
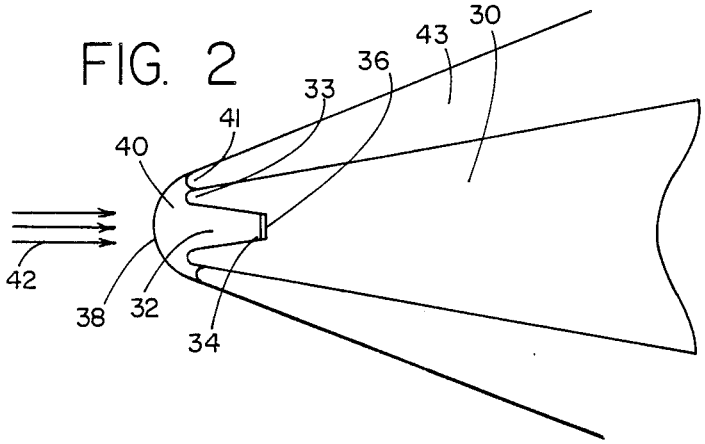
FIG. 2 is a cross sectional side view of the present invention.

In FIG. 2, a longitudinal cross-sectional view of the nose configuration of the present system is provided. The configuration includes cavity 32 annularly surrounded by a rim 33. The shape of the rim is convex in cross section in order to present a blunted front surface to the hypersonic flow stream 42. The blunt design thus achieves a reduction of heat flux concentration at the rim as sharp points are minimized. The blunt shaped rim also provides a detached bowshock at the nose of the aircraft.

The base 34 of nose cavity 32 is formed sufficiently deep in the cavity to minimize convective heat flow along the base portion and conductive heat flow along the rim 33 and the cavity walls 35. Optical window 36 is formed integral to the base wall. The optical window is constituted of sapphire, although other materials having the requisite thermal and optical qualities for endoatmospheric applications may also be used.

Characteristics of hypersonic flow 42 include maintenance of nearly constant density subsonic flow 40 within the cavity and behind bowshock 38. Thus, when subjecting nose 30 to the hypersonic flow stream, a detached bowshock is created which insulates cavity 32 from many of the drawbacks described with reference to FIG. 1.

However, the bowshock oscillates at periodic damped movements where the frequency of oscillations corresponds to the acoustic frequency of the cavity depth. The detachment of the bowshock appears to result from a vortex flow inside the cavity which prevents the bowshock from entering the cavity. It was also observed that the vortex changes position in correspondence with bowshock oscillations. The shock stability thereby increases with the shallowness of the cavity. The cavity flow fields are smooth for a shallow cavity.

Implementation of the cavity structure also improves temperature and optical characteristics about the optical window. The present invention first achieves a substantial reduction in the heat transfer coefficient. Under wind tunnel tests, the foremost points of the nose as compared with the cavity coefficients manifested a reduction of approximately two thirds. Temperature rise between the rim of the nose and the recessed window also bore significant results.

The hollow nose design has also reduced the heat transfer coefficient. Since the foremost point of the nose rim is not a stagnation point, the nose material will not heat to temperature levels experienced by hemispherical nose cones. When compared to conventional nose cones, the foremost point heat transfer coefficient is about 2.5 times lower than that of a blunt nose of equal radius. The thermal measurements conducted during the previously described wind tunnel tests have demonstrated that the heat flux and heat transfer coefficient at the cavity base were about one-third to that of the nose rim. Estimates were calculated for an altitude of 60,000 feet using 6AL-4V-Titanium for the nose tip and sapphire for the window. Window temperatures at these altitudes were found to be consistently below the material self-emission temperatures.

A further advantage of the present configuration is the improved optical characteristics of the design. In particular, because the window is located within a substantially non-turbulent area, the unsteady density fluctuations in the window are absent. Thus, in cavity 32, the window field of view is filled with a nearly constant density gas in order to minimize any refraction effects upon the shock layer. The view through the vehicle bowshock 40 is nearly normal, even at moderate angles of attack, thus eliminating higher order optical aberrations. In addition, scintillation is avoided by virtue of the configuration which allows reduced viscuous heat generation in the window field of view.

Figure 3:
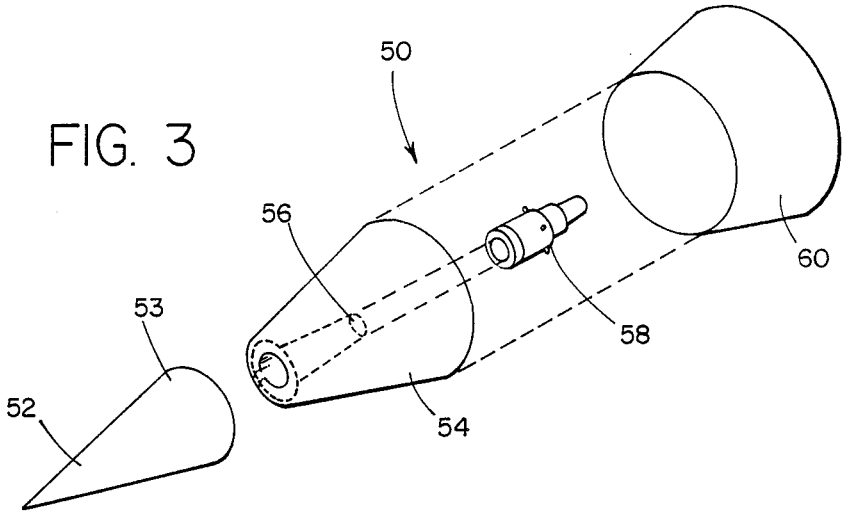
FIG. 3 is an exploded perspective view of the nose cone as shown in FIG. 2 in combination with the shroud and guidance control elements.

FIG. 3 is an exploded perspective view of a preferred embodiment of the invention. As shown, nose portion 54 has a centrally located cavity containing seeker window 56 disposed directly aft of shroud 52. The shroud is designed to be substantially conical having a base portion 53 configured to be secured to the nose. The shroud is designed in a conventional manner such that it can be detached automatically from the nose portion of the aircraft upon obtaining a desired altitude and/or speed.

Located adjacent the nose portion is a range gated active tracker and laser range finder assembly 58. The assembly is mounted substantially interior to the nose 54 and is provided in a gimballed housing (not shown). Also, located adjacent nose portion 54 is a guidance section 60 which will be further described below.

Figure 4:
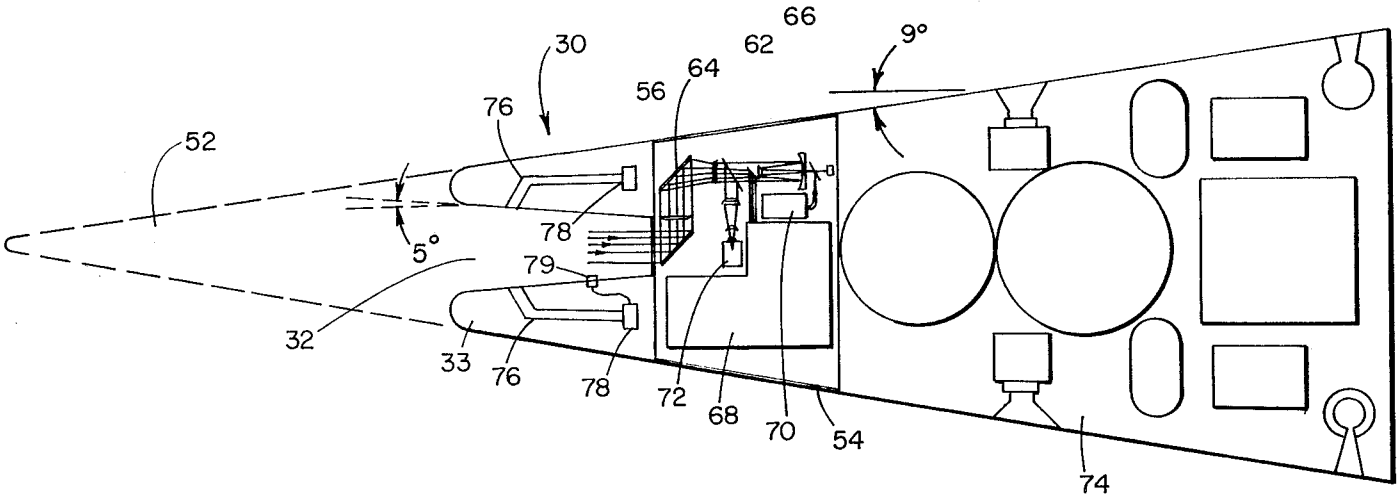
FIG. 4 is the cross sectional view shown in FIG. 2 including a diagrammatic view of the internal seeker and control package elements.

FIG. 4 is a detailed illustration of the arrangement set forth schematically in FIG. 2. Starting at the bow, nose portion 30 is shown having cavity 32 with a plurality of mass flow injection/evacuation channels 76 disposed annularly about the cavity. Each channel is connected to a compressed air source 78 located within rim 33. In operation, a plurality of conventional pressure transducers 79 sense pressure changes inside cavity 32 whereupon compressed gas source 78 is activated to provide a low flow gas injection rate into the cavity.

Gas pressurization has been found to provide desirable results under wind tunnel conditions. In particular, low flow rate gas injection reduces the amplitude of shock oscillations inside the cavity. Corresponding dynamic pressure response throughout the cavity was also reduced significantly. In wind tunnel tests simulating an altitude of 100,000 feet, a speed of mach 10 and a zero degree angle of attack, the RMS dynamic pressure (pounds per square inch) was reduced from 0.75 along the cavity base to approximately 0.30. Gas injection was also found to decrease the heat flux temperature rise ratio between the nose rim and the cavity base. Under wind tunnel tests with injection for a half scale cavity depth, the heat flux ratio of the base to the rim was decreased from 38% to 21% and the ratio and temperature rise decreased from 40% to approximately 24%. Similar results were obtained using mass injection at non-zero angles of attack.

Accordingly, the heat transfer reduction between the rim and the optical window is substantial. The stagnation point heat transfer coefficient as well as the heat flux of the concave nose cone at supersonic speed mach numbers are substantially lower than that of conventionally known convex nose configurations.

FIG. 4 also illustrates an example of a conventional seeker circuit employed in the present nose cone design. The circuit consists of a pair of folding mirrors 64 arranged behind and above optical window 56. The seeker package also includes laser telescope 66, laser transmitter 68, laser range finder/receiving means 70, and an infrared receiving means 72. A missile guidance and control section 74 is placed adjacent the seeker package. The elements of the control section schematically represent conventional hardware for automatically guided aircraft, such as missiles.

Figure 5:
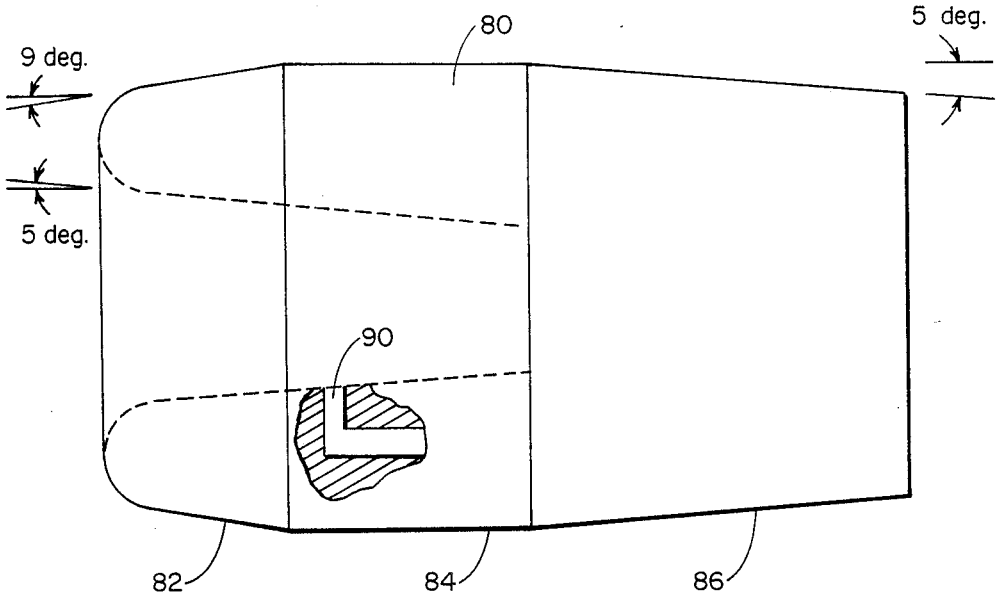
FIG. 5 represents a second embodiment of the present invention.

FIG. 5 represents a wind tunnel test model of the nose configuration. The deep cavity nose is designed to employ a generally convex rim with conical sides angled at approximately 9 and 5 degrees respectively. The cavity, in turn, is provided with four mass flow injection ports 90 each annularly disposed radially at 90 degrees about mid body 84. The aft body section, in turn, is provided to house the seeker assembly.

Figure 6:
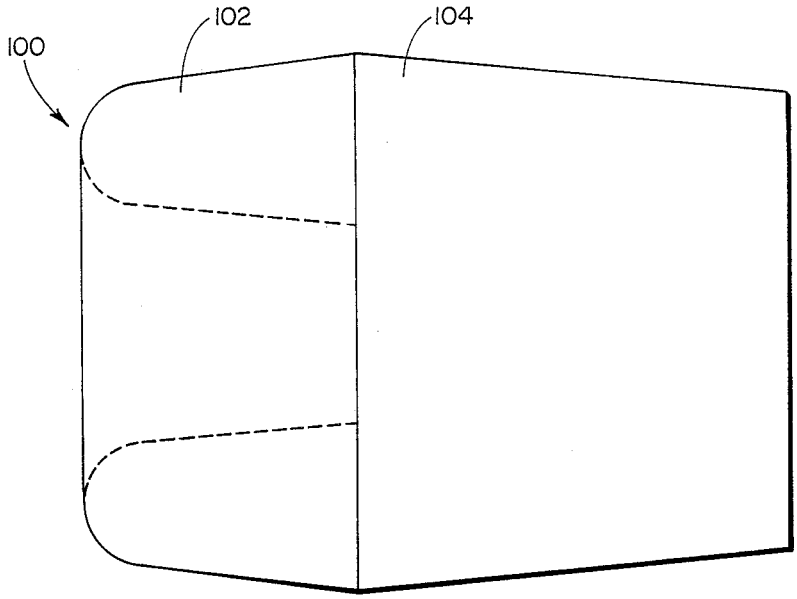
FIG. 6 represents a third embodiment of the present invention.

FIG. 6 illustrates another wind tunnel test model shallow cavity embodiment 100 of the nose configuration shown in FIG. 2. The third embodiment consists of nose portion 102 and an aft portion 104 which is designed to contain the seeker elements as described previously.

Figure 7:
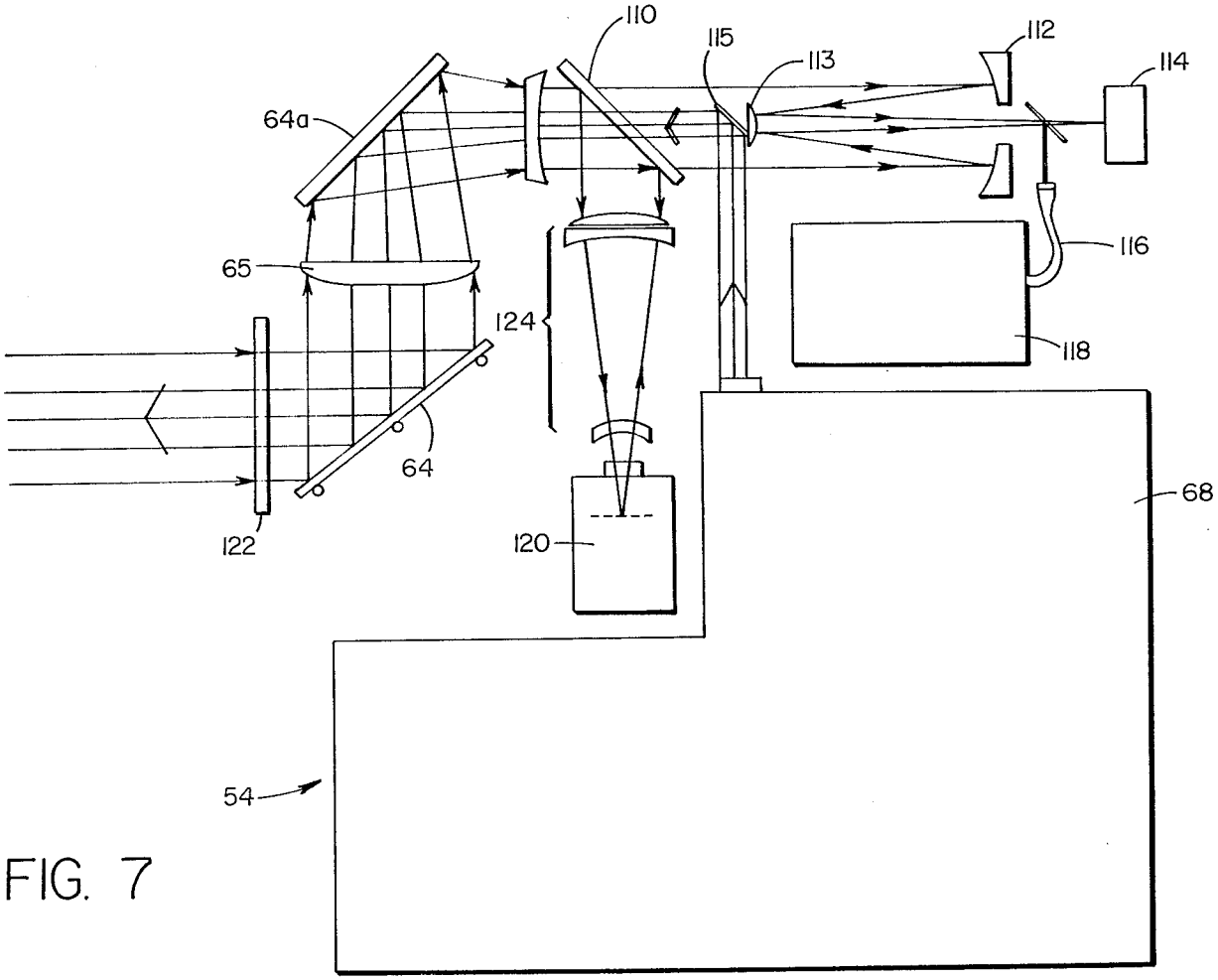
FIG. 7 is a block diagram of the seeker package schematically shown in FIG. 4.

FIG. 7 is a detailed schematic of a conventional optical system employed in the present invention. The optical arrangement includes sapphire window 122 disposed along the base of the cavity in the manner described previously. The system is configured to accommodate laser/infrared (IR) signals. Incoming and outgoing IR and laser signals are directed through lower steering mirror 64. Mirror 64 is adapted to fold optical paths through lens 65 to an upper folding mirror 64*a*. The upper mirror redirects the signals through beam splitter 110 and the beam splitter then separates incoming the infrared signals from laser signals. The infrared signals are then separately directed through telescope assembly 124 to a focal plane/dewar 120. The remaining laser signals are folded by primary mirrors 112 and secondary mirrors 113 along with image intensifier 114. Signals received by the laser receiver are supplied through a fiber optic coupler 116. The laser signals are transmitted via transmitter 68 through folding mirror 115 and then outwardly via steering and folding mirrors 64 to window 122.

Figure 8:
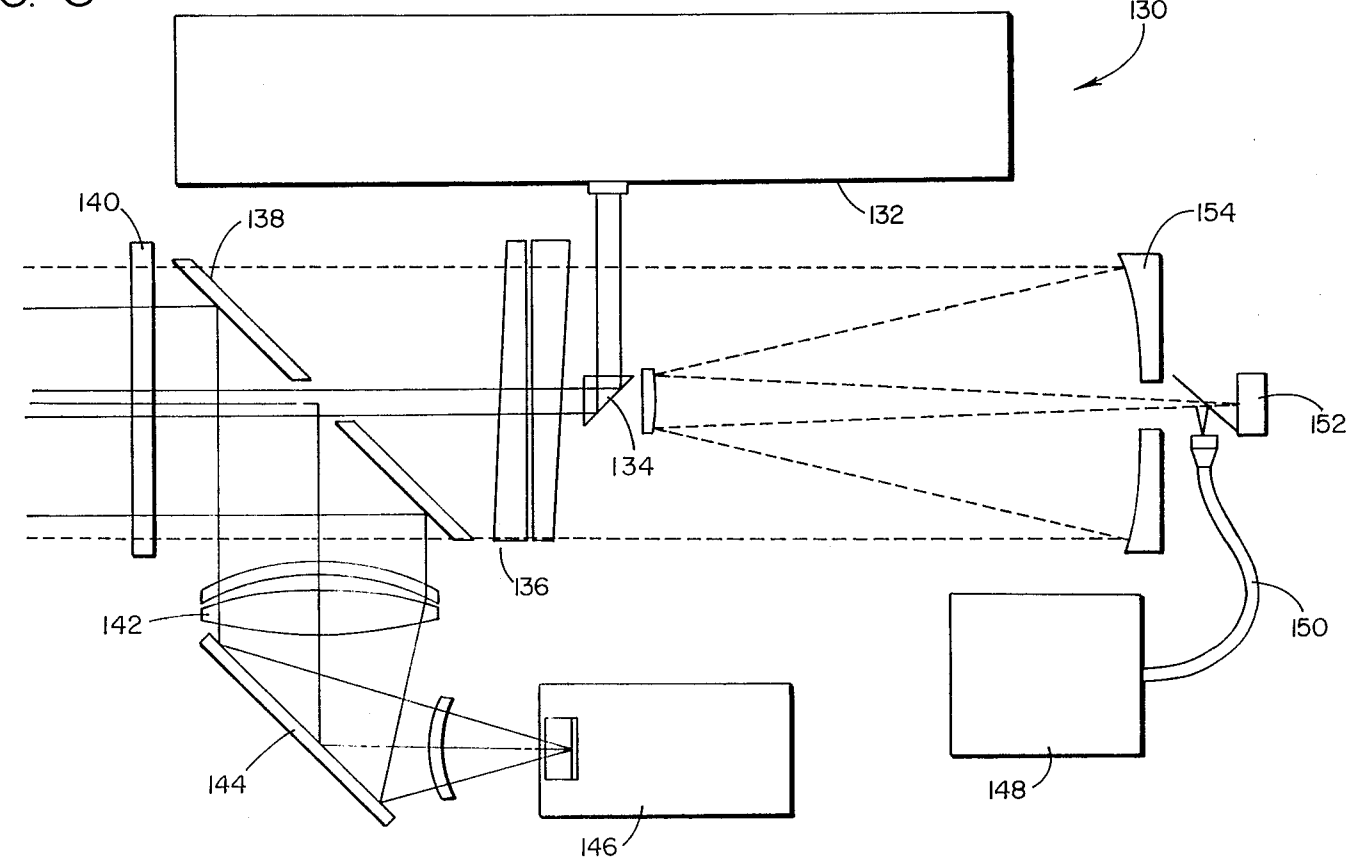
FIG. 8 represents a block diagram of a different embodiment of the seeker package schematically shown in FIG. 4.

A second embodiment package of the seeker 130 is illustrated in FIG. 8. The arrangement in this figure differs from the first embodiment by providing a folding prism 134 in combination with laser beam steering wedges 136 in place of the beam splitter 110 shown in FIG. 7. Additionally, the infrared receiving optics includes infrared scanning mirror 144 which acts to fold signals provided from the infrared steering mirror toward focal plane/dewar 146. The laser range finder/-receiver 148, the fiber-optic coupling 150, the image intensifier 152 and the primary and secondary mirrors are similar to that described previously in FIG. 7.

Using the flow field data from simulated wind tunnel test conditions at mach 10 at an altitude of 85,000 feet and at an angle of attack of zero degrees it was found that the signal optical quality was not affected significantly due to density variations in the hollow nosed configuration. For example, the position of the forward facing optical window can provide greater accuracy in targeting or intercepting. The enhanced accuracy can, in turn, provide significant alterations in the configuration of the aircraft or missile. Thus, the need for a warhead can be obviated as the increased optical accuracy will ensure that the target will be pinpointed. Loss of the warhead engenders savings in weight, and a reduction in the risks of explosion and costs of handling the device. In an aircraft, the need for additional equipment to overcome optical aberrations such as redundant targeting systems can also be eliminated.

The hollow nose cone seeker housing for an aircraft is not limited in its characteristics and applications to the embodiments described. More specially, the present configuration may be applied to other aeronautical structures.

I claim:

1. An aerodynamic shape for hypersonic and supersonic aircraft guidance systems comprising:

a nose having a bow and an aft portion, said bow having a generally convex shape forming an open cavity wherein said open cavity extends toward said aft portion;

a base portion formed at the aft end of said open cavity and being substantially parallel to the foremost plane of said bow; and an optical window extending along said base portion for allowing the passage of guidance signals to and from said aircraft guidance system.

2. The aerodynamic shape according to claim 1, further comprising a gas pressurization/evacuation flow device located about said open cavity for supplying gas to and receiving gas from said open cavity such that a constant pressure is maintained in said open cavity in order to improve optical transmission through said window.

3. The aerodynamic shape according to claim 1, further comprising a seeker package located in said aft portion and mounted behind said optical window.

4. The aerodynamic shape according to claim 3, wherein said seeker package comprises:

laser range finding/receiving means for receiving optical signals through said optical window; and infrared receiving means for receiving infrared signals through said optical window.

5. The aerodynamic shape according to claim 1, further comprising a seeker shroud having a conical shape, said seeker shroud adapted to extend over said foremost plane of said bow such that said seeker shroud automatically detaches from said nose during flight.

6. The aerodynamic shape according to claim 1, wherein reduced heat transfer at said optical window eliminates a requirement for a window cooling system, thereby reducing weight and design complexity of said aircraft guidance system.

7. The aerodynamic shape according to claim 1, further comprising gas pressurization flow means which injects gas into said open cavity at a low flow rate.

8. The aerodynamic shape according to claim 7, wherein said gas injection reduces the amplitude of shock oscillations in front of said open cavity and further reduces a rise in static pressure and root means square levels of dynamic pressure and heat transfer at said optical window.

9. The aerodynamic shape according to claim 1, further comprising means for maintaining a bowshock in a fully detached state during flight.

10. The aerodynamic shape according to claim 9, wherein said bowshock oscillates at small amplitudes during flight.

11. The aerodynamic shape according to claim 7, wherein gas injection into said open cavity through a gas pressurization flow device decreases the amplitude of oscillations within said open cavity resulting from bowshock movement and the temperatures at said optical window.

12. The aerodynamic shape according to claim 1, wherein pressure inside said open cavity remains nearly constant with variation of angle of attack.

13. The aerodynamic shape according to claim 1, wherein said open cavity is formed at a depth sufficient to achieve reduction in heat transfer due to convention, conduction and radiation and yet close enough to said front surface to minimize constriction of the optical field through said optical window.

14. The aerodynamic shape according to claim 1, wherein said nose has a rim about said open cavity having a generally circular cross section, said rim having a blunt-convex shape along its longitudinal axis in order to reduce heat flux concentration at an end of said rim and eliminate attachment of a bowshock during flight.

15. The aerodynamic shape according to claim 1, wherein a gas pressurization/evacuation flow device is provided substantially along said bow portion of said nose.

16. The aerodynamic shape according to claim 15, wherein said pressurization/evacuation flow device comprises a plurality of channels located circumferentially about said open cavity, said channels being supplied by a compressed air device located in said rim and controlled through feedback pressure signals originating from a plurality of pressure transducers located along said open cavity.

17. A method for reducing temperatures and stabilizing pressures in hypersonic and supersonic aircraft housing, comprising:

forming a generally convex nose;

measuring an open cavity in said nose at a depth sufficient to minimize conductive and convective heat flow while maximizing the optical field of view from and end of said open cavity;

forming said open cavity at said measured depth; and locating an optical window along base of said open cavity such that said window provides an optical path near normal to the longitudinal axis of said nose.

18. The method according to claim 17, further comprising gimbal mounting said seeker apparatus aftward to said optical window.

19. The method according to claim 17, wherein formation of said open cavity results in substantially reduced heat and pressure about said optical window eliminating a need for window coolants and warhead.

20. The method of claim 17, further comprising injecting/evacuating gas into said cavity to provide a constant pressure on said open cavity during flight on order to improve optical transmission through said optical window.

21. A hypersonic and supersonic aircraft nose shape for housing a guidance system comprising:

a nose having a rim and an aft portion, said rim having generally convex shaped sides forming an open cavity along said rim wherein said open cavity extends toward said aft portion;

a base portion formed at an end of said open cavity and being substantially parallel to the foremost plane of said rim;

an optical window extending along said base portion; and gas pressurization/evacuation means for supplying gas to and receiving gas from said open cavity, such that reduced heat and a stable pressure environment is formed about said optical window in order to improve optical transmission through said window.

22. The aircraft nose according to claim 21, wherein said gas pressurization/evacuation means injects gas into said open cavity at a low flow rate.

23. The aircraft nose according to claim 21, wherein gas injection from said gas pressurization/evacuation means reduces temperature rise in said open cavity along with root means square levels of fluctuating pressure and window heat transfer.

24. The aircraft nose according to claim 21, wherein said gas pressurization/evacuation flow device comprises a plurality of channels located circumferemtially about an open cavity, said channels being supplied by a compressed air device located along sides of said open cavity and controlled through feedback pressure signals originating from a plurality of pressure transducers located along said open cavity.

25. The aircraft nose according to claim 21, wherein reduced heat transfer at said optical window eliminates window coolants resulting in an overall weight reduction for said guidance system.

26. The aircraft nose, according to claim 21 wherein said gas pressurization/evacuation means reduces shock oscillations in said open cavity such that pressure in said open cavity remains at a stagnation altitude or angle of attack.

27. The aircraft nose according to claim 26, wherein gas injection reduces rise in static pressure as well as root-mean-square levels of fluctuating pressure and window heat transfer.

28. The aircraft nose according to claim 27, wherein gas injection through said gas pressurization/evacuation means decreases the amplitude of said fluctuating pressure and temperature oscillations at said window.

29. The aircraft nose, according to claim 21, comprising means for maintaining a bowshock in a fully detached state during flight.

30. The aircraft nose according to claim 21, wherein said open cavity is formed at a depth sufficient to achieve reduction in flow velocity at said optical window, to minimize heat convection at said optical window, to minimize conductive heat flow produced along sides of said open cavity, and to minimize constriction of an optical field at said optical window.

31. The aircraft nose according to claim 21, wherein said bow portion includes a rim formed about said open cavity and having a generally circular cross-section such that said rim forms a blunt-convex shape along its longitudinal axis thereby reducing heat flux concentration at said rim and eliminates attachment of a bowshock to said aircraft nose.

32. The aircraft nose according to claim 31, wherein said gas pressurization/evacuation flow device is provided substantially in said rim.

33. The aircraft nose according to claim 32, wherein said pressurization/evacuation means, comprises:

a plurality of channels located circumferentially about said open cavity, said channels being supplied by a compressed air device located in said rim;

a plurality of pressure transducers located along said open cavity for controlling said compressed air device.

34. The aircraft nose according to claim 21, wherein higher order optical defects are eliminated through said window due to normal lines of sight through a bowshock.

35. A hypersonic and supersonic aircraft nose cone structure for housing a guidance system, comprising:

a nose having a rim and aft portion, said rim having generally convex sides forming an open cavity along said rim wherein said open cavity extends toward said aft portion and forms a generally circular shape in cross section;

a base portion formed at an end of said open cavity and being substantially parallel to a flattened front surface;

an optical window extending along said base portion;

gas pressurization/evacuation means for supplying gas to and receiving gas from said open cavity;

a seeker shroud having a conical shape, said shroud having a base adapted to extend over said front surface such that said shroud is automatically detached from said nose during flight;

a seeker package located adjacent to said aft portion, said package being gimbal mounted;

guidance means adjacent said seeker wherein said nose cone provides reduced heat and stable pressure about said optical window such that improved optical transmission or reception through said window is achieved.

36. An aerodynamic shape, comprising:

a nose having a bow and aft portion;

a rim formed on said nose, said rim defining an open cavity having a generally circular cross section and said rim having a blunt-convex shape along its longitudinal axis;

a base portion formed at the aft end of said open cavity and being substantially parallel to a foremost plane of said bow; and an optical window extending along said base portion.

37. An aerodynamic shape for hypersonic and supersonic aircraft, comprising:

a nose having a bow and aft portion, said bow having a generally convex shape forming an open cavity wherein said open cavity extends toward said aft portion;

a base portion formed at the aft end of said open cavity and being substantially parallel to the foremost plane of said bow; and an optical window extending along said base portion.

* * * * *